US006540845B1

(12) United States Patent
Oyama et al.

(10) Patent No.: US 6,540,845 B1
(45) Date of Patent: Apr. 1, 2003

(54) AQUEOUS METAL SURFACE TREATING AGENT

(75) Inventors: Masaki Oyama, Chigasaki (JP); Hirokuni Okada, Yokohama (JP)

(73) Assignee: Nippon Dacro Shamrock Co., Ltd. (JP)

( * ) Notice: Subject to any disclaimer, the term of this patent is extended or adjusted under 35 U.S.C. 154(b) by 0 days.

(21) Appl. No.: 10/048,633

(22) PCT Filed: May 3, 2001

(86) PCT No.: PCT/JP01/04535

§ 371 (c)(1),
(2), (4) Date: Apr. 25, 2002

(87) PCT Pub. No.: WO01/92599

PCT Pub. Date: Dec. 6, 2001

(30) Foreign Application Priority Data

May 31, 2000 (JP) ..... 2000-163396

(51) Int. Cl.[7] ..... C23C 22/13

(52) U.S. Cl. ..... 148/248; 106/14.12; 106/14.44; 148/259

(58) Field of Search ..... 106/14.12, 14.44; 148/248, 259

(56) References Cited

U.S. PATENT DOCUMENTS

| | | | | | |
|---|---|---|---|---|---|
| 3,644,152 | A | * | 2/1972 | Schlossberg et al. | 148/254 |
| 4,255,305 | A | * | 3/1981 | Howell, Jr. | 428/416 |
| 4,311,535 | A | * | 1/1982 | Yasuhara et al. | 148/262 |
| 4,517,029 | A | * | 5/1985 | Sonoda et al. | 148/246 |
| 5,141,575 | A | * | 8/1992 | Yoshitake et al. | 148/247 |
| 5,507,884 | A | * | 4/1996 | Ogino et al. | 148/258 |
| 5,792,283 | A | * | 8/1998 | Roland et al. | 148/260 |
| 6,231,688 | B1 | * | 5/2001 | Ishii et al. | 148/259 |
| 6,361,623 | B1 | * | 3/2002 | Ishikura et al. | 148/254 |
| 6,368,426 | B1 | * | 4/2002 | Sienkowski et al. | 148/253 |

FOREIGN PATENT DOCUMENTS

| | | |
|---|---|---|
| JP | 04-128383 | 4/1992 |
| JP | 05-263263 | 10/1993 |
| JP | 08-245988 | 9/1996 |
| JP | 09-003656 | 1/1997 |

* cited by examiner

*Primary Examiner*—Anthony J. Green
(74) *Attorney, Agent, or Firm*—Webb Ziesenhiem Logsdon Orkin & Hanson. P.C.

(57) ABSTRACT

The present invention provides an aqueous agent for treating metal surfaces capable of degreasing and forming a zinc phosphate coat simultaneously. The present metal surface treating agent includes an aqueous solution that includes water and a water-soluble organic solvent where the amount of water is larger than the amount of the water-soluble organic solvent; phosphate ions; nitrate ions; and zinc ions.

6 Claims, No Drawings

AQUEOUS METAL SURFACE TREATING AGENT

BACKGROUND OF THE INVENTION

1. Field of the Invention

The present invention relates to an aqueous agent for treating metal surfaces, more particularly to an aqueous agent for treating metal surfaces that is capable of removing oils adhering to metal surfaces and of forming a water-insoluble zinc phosphate coat on the surfaces.

2. Description of Related Art

The invention disclosed in examined Japanese patent application publication No. 57-49111(1982) relates to a conventional technology of forming an iron phosphate coat on a metal surface to provide the surface with rust resisting properties. The publication teaches a composition for producing a phosphate on a metal surface to form an essentially water-insoluble iron phosphate coat that has an improved surface-adhesion and enhanced humidity resistance. Although the iron phosphate coat made by this composition worked sufficiently as a primer coat that was used in some fields, the coat was inferior in rust prevention compared with a zinc phosphate coat formed by an aqueous composition that was used in the automobile industry and home electric appliances industry.

Unexamined Japanese patent application publication No. 52-107244(1977) discloses another composition. This composition is a zinc phosphate coat-forming agent prepared by mixing an acidic zinc phosphate aqueous solution that includes zinc ions and phosphate ions with nitrate ions and chlorate ions so that the ratio of nitrate ions to chlorate ions and that of phosphate ions to chlorate ions to nitrate ions are respectively within specified ranges. However, forming a zinc phosphate coat on a metal surface using the aqueous agent required complicated multiple steps; degreasing step, water washing step, pure water washing step, surface-conditioning step, coat-forming step, water washing step, pure water washing step and drying step in this order. Another defect was that, because a great amount of water was necessary for this process, the dehydration required special equipment and was costly. Besides, because the nitrate ions serve as a catalyst in this composition, as the concentration of nitrate ions was increased, the value of pH was decreased, which led to a failure in forming the coat.

In order to remove the defects of this zinc phosphate coat-forming agent, a phosphoric acid-treating agent was proposed in unexamined Japanese patent application publication No. 4-128383(1992). This phosphoric acid-treating agent is substantially a non-aqueous composition for forming a phosphoric acid coat on a metal surface, comprising a first solvent mixture of 100 parts by weight of a polar organic solvent with not more than 100 parts by weight of water, phosphoric acid, zinc ions and a solubilizer, wherein the phosphoric acid, the zinc ions and the solubilizer are present in specific amounts respectively based on 100 parts by weight of the first solvent mixture.

The phosphoric acid agent of unexamined Japanese patent application publication No. 4-128383(1992), however, contains a large amount of polar organic solvent and therefore is inflammable. The user has to handle it with a great care. In the examples of this publication are used for the polar solvent methanol, ethanol, isopropanol, t-butanol, ethylene chloride and acetonitrile. When the amount of water exceeds 100 parts by weight based on 100 parts by weight of these polar solvents, the solubility of the formed coat increases, which hinders the formation of a substantially uniform coat. The phosphoric acid agent described in this publication includes not less than 50% of the polar solvent and therefore oil adhering to the metal surface being treated dissolves in the polar solvent very well. In other words, this phosphoric acid agent removes oil that is present on the metal surface being treated by dissolving the oil in the polar solvent the agent includes in an amount larger than the amount of water. As the agent is used repeatedly, the polar solvent becomes saturated with oil. Then the phosphoric acid agent separates into a solvent layer that includes oil with a small amount of water, phosphate ions, zinc ions and the solubilizer and a water layer that includes water, phosphate ions, zinc ions and the solubilizer with a small amount of the polar solvent. This separation hinders a normal formation of the zinc phosphate coat. Consequently, it is absolutely necessary to regularly control the amount of oil that dissolves in the phosphoric acid agent. In other words, as the amount of oil dissolved in the phosphoric acid agent increases, the agent requires such a complicated maintenance as a replacement of the solution or regeneration thereof by distillation. In view of these problems, treating agents that require an easier maintenance have been desired.

The object of the invention is to solve the aforementioned problems. Specifically, an objective of the invention is to provide an aqueous agent for treating metal surfaces, in which agent a metal article is immersed to remove from the surface of the metal article such oils as lubricating oil, examples of which are cutting oil and hydraulic actuation oil, and preservative oil, and to form a zinc phosphate coat on it. Another objective of the invention is to provide an aqueous agent for treating metal surfaces which makes the removed oil float to the surface of the agent when the amount of the dissolved oil reaches to the saturation, whereby the excessive oil can easily be removed and the agent does not separate into layers. A still further objective of the invention is to provide an aqueous agent for treating metal surfaces, with which can desirably be formed a zinc phosphate coat excellent in adhesion and preservative properties.

SUMMARY OF THE INVENTION

In the present invention, the aforementioned problems are solved by an aqueous agent for treating metal surfaces including 100 parts by weight of an aqueous solution that comprises from more than 12 weight % to less than 50 weight % of a water-soluble organic solvent and from more than 50 weight % to less than 88 weight % of water, 0.01–4.25 parts by weight of phosphate ions, 0.02–45 parts by weight of nitrate ions, and 0.01–6.5 parts by weight of zinc ions.

In a preferred embodiment of the invention, the aqueous solution comprises from more than 12 weight % to 45 weight % of the water-soluble organic solvent and from 55 weight % to less than 88 weight % of the water.

In another preferred embodiment of the invention, the water-soluble organic solvent is at least one glycol compound selected from the group consisting of diethylene glycol, triethylene glycol, tetraethylene glycol, propylene glycol, ethylene glycol monoalkyl ether, diethylene glycol monoalkyl ether and propylene glycol monoalkyl ether, or a mixture of the glycol compound with a lower alcohol.

In a further preferred embodiment, the respective aqueous agents of the aforementioned embodiments additionally include up to 6 parts by weight of monovalent ions of an alkaline metal.

DESCRIPTION OF THE PREFERRED EMBODIMENTS

Generally, when a treating agent for forming a zinc phosphate coat on a metal surface is aqueous, the process of the formation requires complicated multiple steps; degreasing step, water washing step, pure water washing step, surface-conditioning step, coat-forming step, etc. The aqueous agent for treating metal surfaces in accordance with the invention, however, does not require such multiple steps but needs only one step in one tank for degreasing and forming a zinc phosphate coat. Another advantage is that the aqueous agent of the invention can remove oils from the metal surface although the agent is aqueous, and form a uniform zinc phosphate coat on the surface. In a case where is employed a conventional non-aqueous phosphoric acid agent including a water-containing solvent that comprises 50% or more of alcohol and a water-containing organic solvent that comprises 50% or more of chlorinated hydrocarbons, the formed coat is more dissolved in the agent and a substantially uniform coat can hardly be obtained when the amount of the water exceeds 100 parts by weight for 100 parts by weight of the polar organic solvent. (See page 3, lower left column, lines 15–17 of unexamined patent application publication No. 4-128383(1992).) Besides, a user of the non-aqueous phosphoric acid agent of the publication had to fill a space just above the surface of the composition solution with vapor of the agent and expose the surface of the treated metal article to the vapor for a long time for degreasing. After the degreasing, the user immersed the metal article in the non-aqueous phosphoric acid composition to form a zinc phosphate coat on the surface. On the other hand, a user of the aqueous agent for treating metal surfaces in accordance with the invention can immediately immerse a metal article in the agent for simultaneous degreasing and coat-forming.

The aqueous agent, which has these unique advantages, includes from more than 12 weight % to less than 50 weight % of a water-soluble organic solvent and from more than 50 weight % to less than 88 weight % of water based on the total weight of the water-soluble organic solvent and the water.

Examples of the water-soluble organic solvent are an ethylene glycolic lower alkyl ether or ethylene glycolic lower alkyl ester represented by the formula $(—CH_2—CH_2—O—)_n$ wherein n is 1–4, a lower alkyl ether or lower alkyl ester of propylene glycol or dipropylene glycol, a lower alkylene glycol such as diethylene glycol, triethylene glycol or tetraethylene glycol, a lower alcohol, an ester, etc.

The ethylene glycolic lower alkyl ether or ethylene glycolic lower alkyl ester includes ethylene glycol monoethyl ether, ethylene glycol mono-n-butyl ether, triethylene glycol mono-n-butyl ether, tetraethylene glycol mono-n-butyl ether, acetic ethylene glycol monoethyl ether, acetic diethylene glycol monoethyl ether, etc.

The lower alkyl ether or lower alkyl ester of propylene glycol or dipropylene glycol includes propylene glycol butyl ether, dipropylene glycol monomethyl ether, polypropylene glycol monoethyl ether, etc.

The lower alcohol includes, for example, alcohols having 1–8 carbon atoms such as ethyl alcohol, isopropyl alcohol, tert-butyl alcohol, methoxydimethyl pentanol, or diacetone alcohol.

The ester includes ethyl lactate, methoxybutyl acetate, butyl acetate, etc.

The water-soluble organic solvent suitable for this invention is at least one glycol compound selected from the group consisting of diethylene glycol, triethylene glycol, tetraethylene glycol, propylene glycol, ethylene glycol monoalkyl ether, diethylene glycol monoalkyl ether and propylene glycol monoalkyl ether, or a mixture of the glycol compound with a lower alcohol. The alkyl group of the glycol compound preferably has 1–5 carbon atoms. Of the lower alcohol, one having 1–8 carbon atoms is preferable. More preferable is a lower alcohol having 1–5 carbon atoms and most preferable 1–4 carbon atoms.

If the aqueous agent for treating metal surfaces in accordance with the invention has not more than 12% by weight of the water-soluble organic solvent and more than 88% by weight of water, the degreasing may be imperfect. This insufficient degreasing may cause problems such as repelling or crawling in the following painting step, and further result in a poor adhesion of the paint. Besides, although zinc phosphate precipitates partly on the metal surface, the major part of the surface is covered with a blue iron phosphate coat, which leads to a failure in the formation of an intended uniform zinc phosphate coat excellent in paint adhesion. On the other hand, when the agent has not less than 50% by weight of the water-soluble organic solvent and less than 50% by weight of water, the agent requires an inorganic acid as a solubilizer to uniformly dissolve phosphoric acid and inorganic compounds, a source of zinc ions, both of which are components of the coat. Consequently, the pH of the agent that includes a large amount of the water-soluble organic solvent is lowered, which leads to overetching of the metal surface and results in producing a large amount of sludge. When the amount of sludge increases, a frequent examination of the apparatus that is contacted with the treating agent is required so that the apparatus is kept in a good condition. Besides, the agent remains on the treated metal, which is a cause of inferior products.

The aqueous agent for treating metal surfaces in accordance with the invention includes phosphate ions. Examples of the source of the ions are orthophosphoric acid, pyrophosphoric acid, polyphosphoric acid, trimetaphosphric acid, tetrametaphosphric acid, etc. Of them orthophosphoric acid and polyphosphoric acid are preferable. From the viewpoint of production cost, orthophosphoric acid is the most preferable.

The amount of the phosphate ions in the aqueous agent is from 0.01 to 4.25 parts by weight, preferably from 0.04 to 2.5 parts by weight for 100 parts by weight of the total of water and the water-soluble organic solvent.

If the amount of phosphate ions is less than 0.01 part by weight, the formation of the zinc phosphate coat does not proceed desirably and the intended uniform coat excellent in paint adhesion cannot be formed. On the other hand, if the amount exceeds 4.25 parts by weight, the treated metal dissolves in the agent and maintaining the agent in a stable condition becomes impossible.

The amount of nitrate ions in the aqueous agent is 0.02–45 parts by weight, preferably 1.2–25 parts by weight based on 100 parts by weight of the total of the water-soluble organic solvent and water. If the amount of nitrate ions is less than 0.02 part by weight, a smaller amount of zinc dissolves in the agent, which hinders desirable formation of a zinc phosphate coat. If the amount exceeds 45 parts by weight, the surface of the treated metal is overetched and a larger amount of sludge is produced. As a result, a frequent examination of the apparatus is required so that the apparatus is kept in a good condition, which increases the production cost.

For nitrate ion sources may be listed nitric acid and nitrates.

The amount of zinc ions in the aqueous agent is 0.01–6.5 parts by weight, preferably 0.1–3.5 parts by weight based on 100 parts by weight of the total of the water-soluble organic solvent and water. If the amount of zinc ions is less than 0.01 part by weight, a uniform coat cannot be formed on the surface of an article made of an iron or aluminum material that does not include zinc. If the amount exceeds 6.5 parts by weight, the solubility of zinc in the aqueous solution comprising water and the water-soluble organic solvent becomes poor.

For zinc ion sources may be listed zinc phosphate, zinc hydroxide, zinc carbonate, zinc oxide, zinc chloride, zinc nitrate, zinc sulfate, etc.

The aqueous agent for treating metal surfaces of this invention may further include as a metal ion nickel ions, manganese ions, calcium ions and monovalent alkaline metal ions.

The agent accepts nickel ions in an amount up to 3 parts by weight, preferably up to 2 parts by weight based on 100 parts by weight of the total of water and the water-soluble organic solvent. When nickel ions are employed as a component of the agent, the amount of the ions is preferably 0.01–1 part by weight based on 100 parts by weight of the total of water and the water-soluble organic solvent. Nickel ions in the aqueous agent further enhance preservative properties of the coat before being painted.

The agent accepts manganese ions in an amount up to 3 parts by weight, preferably up to 1 part by weight based on 100 parts by weight of the total of water and the water-soluble organic solvent. When manganese ions are employed as a component of the agent, the amount of the ions is preferably 0.01–1 part by weight based on 100 parts by weight of the total of water and the water-soluble organic solvent. Manganese ions in the aqueous agent improve the adhesion of the coat in a wet condition, when an article made of a material including zinc is treated with the agent.

The agent accepts calcium ions in an amount up to 3 parts by weight, preferably up to 1 part by weight based on 100 parts by weight of the total of water and the water-soluble organic solvent. When calcium ions are employed as a component of the agent, the amount of the ions is preferably 0.01–1 part by weight based on 100 parts by weight of the total of water and the water-soluble organic solvent. Calcium ions in the aqueous agent improve the preservative properties of the coat, which was proven by the salt spray test.

The agent accepts monovalent alkaline metal ions, such as lithium ions or sodium ions, in an amount up to 6 parts by weight, preferably up to 4.5 parts by weight based on 100 parts by weight of the total of water and the water-soluble organic solvent. When monovalent alkaline metal ions are employed as a component of the agent, the amount of the ions is preferably 0.1–4.5 parts by weight based on 100 parts by weight of the total of water and the water-soluble organic solvent. Alkaline metal ions in the aqueous agent together with excessive water make the crystals in the zinc phosphate coat finer, which further enhances the adhesion of the coat and contributes to achieving the objectives of the invention.

The aqueous agent of this invention may be prepared by uniformly mixing water, the water-soluble organic solvent, the nitrate ion source, the phosphate ion source and zinc ion source at, for example, an ambient temperature with a known mixing device.

A metal surface may be treated with this aqueous agent by, for example, immersing the metal article in the agent that has been heated to, usually 30–90° C., preferably 40–60° C., for usually 5 seconds to 30 minutes, preferably 15 seconds to 10 minutes. Other methods are, for example, a treatment by spraying and that by flow casting. Preferable is the treatment by immersing. When a metal article is treated by the immersing method, the employment of the agent in accordance with the invention can simplify the conventional degreasing step and zinc phosphate coat-forming step to one step in one tank. For the metal article that can suitably be treated with this aqueous agent may be mentioned any metal article that requires the zinc phosphate coat on the surface thereof.

When the aqueous agent of this invention is employed, the user does not have to subject in advance the metal surface to degreasing, water washing after the degreasing, pure water washing after the water washing and surface-conditioning after the pure water washing. Only immersing a metal article in the aqueous agent without any preparation can remove oils from the surface thereof and form a zinc phosphate coat thereon. In addition, the employment of this agent can omit such a complicated process as filling a space ranging from just above the surface of a conventional aqueous metal surface-treating agent to a predetermined height with vapor of the agent made by heating it, exposing the surface of the treated metal article to the vapor for a predetermined time for degreasing, and immersing the metal article in the agent. As mentioned above, only one immersion of a metal article in the aqueous agent without any preparation can remove oils from the surface of the metal article and form a zinc phosphate coat thereon. The aqueous agent of this invention is worth notice also for this advantage.

However, please note if a metal article is immersed in an aqueous agent of which temperature is less than 30° C., the removal of oils adhering onto the surface might not proceed very well. It might further cause such problems as repelling or crawling and poor adhesion of the coat in the coat formation. Sometimes, even the coat formation itself is not carried out desirably. As a result, the formation of a zinc phosphate coat excellent in adhesion to the surface and preservative properties, which is the object of the invention, might not be achieved. On the other hand, even if the aqueous agent has been heated to a temperature of more than 90° C. when a metal article is immersed therein, such heating does not produce effects corresponding to the energy consumption. From the viewpoint of the energy cost and the exhaustion of chemicals, such heating is uneconomical and therefore not industrial.

If the immersion time is less than 5 seconds, the removal of oils adhering onto the surface of a metal article being treated might not be carried out very well. On the other hand, if the time is more than 30 minutes, it does not produce effects corresponding to the long-time treatment, although the degreasing and the formation of the coat are possible.

EXAMPLES

Examples of the invention will be presented hereafter. Needless to say, the invention is not limited to the following examples, and modifications and changes can be made within the spirit and scope of the invention.

Working Examples 1–6

Ion exchanged water of an amount shown in Table 1 and a water-soluble organic solvent of which amount and kind are shown in Table 1 were mixed in a glass beaker. An inorganic acid and an inorganic acid salt, the respective kinds and amounts of which are shown in Tables 1 and 2, were added to the mixture in the beaker. The unit of the respective amounts in the tables is part(s) by weight. The mixture was stirred for ten minutes and an aqueous agent for treating metal surfaces was obtained.

A SPCC-SD steel test piece (dimensions: 0.8×70×150 mm) as a test panel was immersed in the obtained aqueous agent, which was maintained at a temperature shown in Table 2, for a length of time shown in the same table. While the test panel was being immersed in the agent, the agent was sometimes stirred.

Immediately after the immersing time elapsed, the test panel was taken out of the agent. The surface of the panel was washed with service-water, then with ion-exchanged water and dried with a drier.

TABLE 1

| Working Example | 1 | 2 | 3 | 4 | 5 | 6 |
|---|---|---|---|---|---|---|
| Amount of ion-exchanged water | 70 | 60 | 55 | 60 | 75 | 70 |
| Water-soluble organic solvent | DEGMBE 30 | Butyl-Cello-solve 10 Methoxy-Propanol 30 | DEGMBE 10 IPA 35 | IPA 20 Diethyl-ene glycol 20 | Methoxy-Propanol 20 IPA 5 | DEGMBE 30 |
| Phosphate ions | 85% phos-phoric acid 0.7 (0.6) | 85% phos-phoric acid 0.2 (0.17) | 85% phos-phoric acid 1 (0.85) | 85% phos-phoric acid 0.4 (0.34) | 85% phos-phoric acid 1.9 (1.62) | 85% phos-phoric acid 2.1 (1.79) |
| Nitrate ions (Total) | (0.2) | 61% nitric acid 1.78 (1.13) | (12.1) | (19.3) | (5.06) | (4.66) |
| Zinc ions | Zinc nitrate 0.5 (0.1) | Zinc oxide 0.7 (0.56) | Zinc nitrate 30 (6.26) | Zinc nitrate 1.7 (0.35) | Zinc nitrate 5 (1.04) | Zinc nitrate 2.5 Zinc oxide 0.15 (0.64) |

DEGMBE - diethylene glycol mono-n-butyl ether Butyl Cellosolve - 2-butoxy ethanol (Union Carbide, Danbury, Conn.) IPA - isopropyl alcohol

TABLE 2

| Working Example | 1 | 2 | 3 | 4 | 5 | 6 |
|---|---|---|---|---|---|---|
| Nickel ions | (0) | Nickel nitrate 0.1 (0.02) | (0) | (0) | Nickel nitrate 4.5 (0.91) | (0) |
| Manga-nese ions | (0) | (0.02) | Manga-nese nitrate 0.5 (0.1) | (0) | Manga-nese nitrate 4.5 (0.86) | (0) |
| Calcium ions | (0) | (0) | (0) | Calcium nitrate 0.7 (0.12) | (0) | (0) |
| Mono-valent alkaline metal ions | (0) | Sodium nitrite 0.01 Sodium nitrate 10 Sodium bicarbonate 0.03 (2.71) | Sodium nitrate 15 (4.06) | Lithium nitrate 20 (2.01) | Sodium nitrate 1 Lithium nitrate 1 Sodium chlorate 0.25 (0.42) | Lithium nitrate 4 (0.4) |
| Temp. of the agent (° C.) | 50–55 | 45–50 | 55–60 | 50–55 | 35–40 | 70–80 |
| Immersion time (minutes) | 10 | 2 | 0.5 | 10 | 15 | 10 |

In Tables 1 and 2, non-parenthesized numerals mean the amounts of the components written just above the numerals in the unit of part(s) by weight, while parenthesized numerals the amounts of the ions written in the most left column.

Each of the zinc phosphate coats formed was observed with an electron microscope and photographed. The longest length of a precipitated crystal was taken as a typical diameter, and the typical diameter was measured and the value is shown in Table 8.

To the test panels on which the respective coats were formed were applied paints having the following commercial names. The thickness of the formed paint coat and the way of the application are shown altogether.

Melami No. 1

An alkyd resin paint produced by Nippon Yushi Kabushiki Kaisha Condition of drying: 20 minutes at 130° C. Thickness of the formed paint coat: 30–30 μm Application method: the paint was diluted with a dedicated thinner to such an extent as the diluted paint showed 19–20 seconds measured with FORD CUP#4, and then applied to the test panel with a spray gun.

Belle Coat No. 1100

An alkyd resin paint produced by Nippon Yushi Kabushiki Kaisha Condition of drying: 20 minutes at 150° C. Thickness of the formed paint coat: 30–40 μm Application method: the paint was diluted with a dedicated thinner to such an extent as the diluted paint showed 19–20 seconds measured with FORD CUP#4, and then applied to the test panel with a spray gun.

Aqua #4200

A cation electro-deposition paint produced by Nippon Yushi Kabushiki Kaisha Condition of drying: 20 minutes at 170° C. Thickness of the formed paint coat: 20–25 μm Application method: the test panel was immersed in the paint that had been maintained at a data temperature of 27–28° C and a voltage of 280 V was applied to the paint for 3minutes. Then the electric current was cut off. The test panel was taken out of the paint and washed with service-water for removing unreacted chemicals. The test panel was further washed with ion-exchanged water, and dried with a blower and then in a drying stove. The service-water and ion-exchanged water used for washing were disposed of as an industrial waste.

The test panels coated with the respective three paints were evaluated in the following methods.

(Degreasing Property)

A drop of ion-exchanged water was let to fall on the respective surfaces of the test panels on which the zinc phosphate coats were formed but before the treatment with the paint compositions above. The degree of wetting of each of the surfaces was evaluated in accordance with the standard shown in Table 3. The test panel before the zinc phosphate coat was formed had been stained with a little amount of lubricating oil, so the degree of wetting of the surface was graded "1" in accordance with the standard.

TABLE 3

| Degree of Wetting based on the Appearance of the Wetted Surface | |
|---|---|
| Degree | Appearance of the wetted surface |
| 5 | Surface is completely wetted. The drop of ion-exchanged water spreads flatly. |
| 4 | The drop takes a disc-likeshape with the middle portion swollen slightly, such as a thin go stone. |
| 3 | The drop takes a dome-like shape. |
| 2 | The drop takes a hemispherical shape. |
| 1 | The drop takes an almost complete spherical shape. |

(Measurement of the Coat Weight)

The test panels on which the zinc phosphate coats had been formed were weighed with a precision balance that could measure a weight down to a value of the fourth figure after the decimal point, and the weights were recorded. The weighed test panels were immersed in a 6% aqueous solution of chromic acid that was kept at a temperature of 90–98° C. for ten minutes, whereby the coats were peeled off. The test panels were taken out from the solution and the peeling solution was washed away from the test panels with service-water. Then the panels were washed with ion-exchanged water and dried. The service-water and ion-exchanged water used for the washing were disposed of as an industrial waste. Again, the test panels were weighed. From the differentials between the weights obtained in the initial measurement and those obtained in the post-peeling off measurement, the weights of the respective coats per unit area were calculated.

(Primary Adhesion)

The surface of each of the painted test panels was scored with an NT cutter so that one hundred squares, each of which had sides of 1 mm, were made on the surface. The adhesion of each paint coat was evaluated using an adhesive tape (a product by Nichiban, the width: 18 mm) by pressing the tape on the scored surface, peeling off the tape therefrom, and counting the number of the squares remaining on the surface.

(Adhesion in a Wet Condition)

The painted panels were kept for a predetermined length of time in a humidity cabinet where the temperature was 50° C. and the relative humidity was not less than 95%. After the time lapsed, the test panels were taken out from the cabinet. The surface of each of the painted test panels was scored with an NT cutter so that one hundred squares, each of which had sides of 1 mm, were made on the surface. The adhesion of each paint coat was evaluated using an adhesive tape (a product by Nichiban, the width: 18 mm) by pressing the tape on the scored surface, peeling off the tape therefrom, and counting the number of the squares remaining on the surface.

(Salt Spray Test)

In a salt spray chamber in accordance with JIS Z-2371 were kept the test panels of which surfaces had been scored with an NT cutter so that one hundred squares, each of which had sides of 1 mm, were made on the surfaces. After a predetermined length of time lapsed, the panels were taken out from the chamber. The adhesion of each paint coat was evaluated using an adhesive tape (a product by Nichiban, the width: 18 mm) by pressing the tape on the scored surface, peeling off the tape therefrom, and counting the number of the squares remaining on the surface.

The results of the evaluation of degreasing property and the measurement of coat weight are shown in Table 8. The results of the evaluations of primary adhesion and adhesion in a wet condition, and the salt spray test are shown in Table 9.

Comparative Examples 1–2

Examples 1–2 of unexamined Japanese patent application publication No. 44-18163(1969) were traced. The compositions of which constituents and amounts are shown in Table 4 were prepared. In Table 4, the low foaming wetting agent was an aliphatic polyether prepared by introducing ethoxyl groups into oxyalcohols.

TABLE 4

| Constituent | Comparative Example 1 | Comparative Example 2 |
|---|---|---|
| Monosodium phosphate | 80.5 | 60 |
| Sucrose | 5.0 | 10 |
| Sodium difluoride | 4.0 | 8.3 |
| Ammonium molybdate | 1.0 | 7.5 |
| Oxalic acid | 3.0 | — |
| Sodium oxalate | — | 7.5 |
| Ferric oxalate | 0.5 | 0.7 |
| Low foaming wetting agent | 6.0 | 6.0 |
| Water | 100 parts by weight of water for 6 parts by weight of the whole constituents above | |

Test panels that were the same as those used in Working Examples 1–6 were treated and evaluated in the same ways as the panels in the examples, except that the above components were used in place of the aqueous agents used in the examples. The results are shown in Tables 10 and 11. The observation of the panel surfaces with an electron microscope revealed that zinc phosphate crystals were not produced.

Comparative Examples 3–5

Treating agents having the compositions shown in Table 5 were prepared in accordance with the examples of unexamined Japanese patent application publication No. 8-245988(1996). In Table 5, EDGEE means ethylene glycol diethyl ether, DEGDEE diethylne glycol diethyl ether, and PGMnPE propylene glycol mono-n-propyl ether.

TABLE 5

| Constituent | Comparative Example 3 | Comparative Example 4 | Comparative Example 5 |
|---|---|---|---|
| EDGEE | 25 | — | — |
| DEGDEE | — | 40 | — |
| PGMnPE | — | — | 50 |
| Water | 75 | 60 | 50 |

Test panels that were the same as those used in Working Examples 1–6 were treated in the same way as the panels in the examples, except that the agents shown in Table 5 were used in place of the aqueous agents used in the examples.

The same evaluations as those in the examples were carried out, except that the observation with an electron microscope was not done. The results are shown in Tables 10 and 11.

Comparative Examples 6–11

Zinc phosphate coat-forming agents having the compositions shown in Table 6 were prepared. Comparative Examples 6 and 7 respectively correspond to Examples 1 and 2 of unexamined Japanese patent application publication No. 52-107244(1977).

Each of the prepared agents of which temperatures are shown in Table 6 was sprayed onto a test panel, which was the same as the panels used in Working Examples 1–6, for a length of time shown in the same table without degreasing treatment, whereby a zinc phosphate coat was formed on the surface of each panel.

In Comparative Examples 6 and 7, the degreasing property and the weight of the coat were evaluated. The results are shown in Table 10.

TABLE 6

| Comparative Example | 6 | 7 | 8 | 9 | 10 | 11 |
|---|---|---|---|---|---|---|
| $Zn^{2+}$ | 2.2 | 7.0 | 2.2 | 2.2 | 7.0 | 7.0 |
| $Mn^{2+}$ | — | 2.0 | — | — | 2.0 | 2.0 |
| $PO_4^{3-}$ | 5.5 | 5.0 | 5.5 | 5.5 | 5.0 | 5.0 |
| $ClO_3^-$ | — | 12 | — | — | 12 | 12 |
| $NO_2^-$ | — | 1 | — | — | 1 | 1 |
| $NO_3^-$ | 1.7 | 2 | 1.7 | 1.7 | 2 | 2 |
| $Fe^{2+}$ | 0.02 | — | 0.02 | 0.02 | — | — |
| PGMnPE | — | — | 200 | 300 | — | — |
| DEGMBE | | | — | — | 200 | 300 |
| Temp. of the Agent (° C.) | 50–55 | 50–60 | 50–55 | — | 50–60 | — |
| Length of time the agent was sprayed | 2 min. | 2 min. | | | | |

Comparative Examples 12 and 13

Examples 4 and 8 of unexamined Japanese patent application publication No. 4-128383(1992) were traced and phosphoric acid treating agents were prepared. The compositions of the agents are shown in Table 7. Test panels that were the same as those used in Working Examples 1–6 were treated and evaluated in the same ways as the panels in the examples, except that the agents shown in Table 7 were used in place of the aqueous agents used in the examples, and each treatment was carried out at a temperature and for a length of time shown in Table 7. The evaluation results are shown in Tables 8 and 9.

TABLE 7

| Constituent | Comparative Example 12 | Comparative Example 13 |
|---|---|---|
| Methylene chloride | 100 | |
| Methanol | 46 | |
| Isopropanol | | 68.6 |
| Acetonitrile | | 24.5 |
| Water | 8 | 6.9 |
| Zinc nitrate | | 0.3 |
| Zinc carbonate | 0.7 | |
| Nickel nitrate | | 0.098 |
| Sodium carbonate | 0.15 | 0.098 |
| Phosphoric acid | 1.5 | 0.49 |
| Nitric acid (solubilizer) | 2.5 | 0.98 |
| Length of time the treatment was carried out (minute) | 8 | 10 |

TABLE 7-continued

| Constituent | Comparative Example 12 | Comparative Example 13 |
|---|---|---|
| Temperature at which the treatment was carried out | Boiling point | 44° C. |

TABLE 8

| Example | Degreasing property | Weight of the coat (g/m²) | Crystal size (μ) |
|---|---|---|---|
| Working Example 1 | 5 | 3.4 | 40–70 |
| Working Example 2 | 5 | 1.8 | 10–15 |
| Working Example 3 | 5 | 1.5 | 10–20 |
| Working Example 4 | 5 | 4.5 | 15–20 |
| Working Example 5 | 5 | 7.0 | 10–20 |
| Working Example 6 | 5 | 3.9 | 10–15 |
| Comparative Example 12 | 5 | 2.5 | 40–70 |
| Comparative Example 13 | 5 | 1.5 | 40–70 |

TABLE 9

| Paint | Melami No. 1 | | | Belle coat No. 1100 | | | Aqua #4200 | | |
|---|---|---|---|---|---|---|---|---|---|
| Time length | | One day | One day | | 10 days | 5 days | | 30 days | 60 days |
| W.Ex.1 | 100 | 100 | 0 mm | 100 | 100 | 0 mm | 100 | 100 | 1 mm |
| W.Ex.2 | 100 | 100 | 0 mm | 100 | 100 | 0 mm | 100 | 100 | 0 mm |
| W.Ex.3 | 100 | 100 | 0 mm | 100 | 100 | 0 mm | 100 | 100 | 0 mm |
| W.Ex.4 | 100 | 100 | 0 mm | 100 | 100 | 0 mm | 100 | 100 | 0 mm |
| W.Ex.5 | 100 | 100 | 0 mm | 100 | 100 | 0 mm | 100 | 100 | 0 mm |
| W.Ex.6 | 100 | 100 | 0 mm | 100 | 100 | 0 mm | 100 | 100 | 0 mm |
| C.Ex.12 | 100 | 100 | 1 mm | 100 | 100 | 0 mm | 100 | 100 | 3 mm |
| C.Ex.13 | 100 | 100 | 2 mm | 100 | 100 | 0 mm | 100 | 100 | 3 mm |

TABLE 10

| Example | Degreasing property | Weight of the coat (g/m²) | Crystal size (μ) |
|---|---|---|---|
| Comparative Example 1 | 4 | 0.25 | — |
| Comparative Example 2 | 4 | 0.37 | — |
| Comparative Example 3 | 5 | 0 | — |
| Comparative Example 4 | 5 | 0 | — |
| Comparative Example 5 | 5 | 0 | — |
| Comparative Example 6 | 2 | — | — |
| Comparative Example 7 | 2 | — | — |
| Comparative Example 8 | — | — | — |
| Comparative Example 9 | — | — | — |
| Comparative Example 10 | — | — | — |
| Comparative Example 11 | — | — | — |

TABLE 11

| | Paint | | | | | | | | |
|---|---|---|---|---|---|---|---|---|---|
| | Melami No. 1 | | | Belle coat No. 1100 | | | Aqua #4200 | | |
| Examination | Primary adhesion | Adhesion in a wetting condition | Salt splay | Primary adhesion | Adhesion in a wetting condition | Salt splay | Primary adhesion | Adhesion in a wetting condition | Salt splay |
| Time length | | One day | One day | | 10 days | 5 days | | 30 days | 60 days |
| C.Ex.1 | 100 | 100 | 2 mm | 100 | 100 | 3 mm | 100 | 98 | 25 mm |
| C.Ex.2 | 100 | 100 | 2 mm | 100 | 100 | 3 mm | 100 | 95 | 28 mm |
| C.Ex.3 | 90 | 0 | 12 mm | 100 | 0 | 8 mm | 100 | 0 | Com- |
| C.Ex.4 | 80 | 0 | 15 mm | 100 | 0 | 9 mm | 100 | 0 | pletely |
| C.Ex.5 | 90 | 0 | 13 mm | 100 | 0 | 8 mm | 100 | 0 | peeled |
| C.Ex.6 | — | — | — | — | — | — | — | — | — |
| C.Ex.7 | — | — | — | — | — | — | — | — | — |
| C.Ex.8 | — | — | — | — | — | — | — | — | — |
| C.Ex.9 | — | — | — | — | — | — | — | — | — |
| C.Ex.10 | — | — | — | — | — | — | — | — | — |
| C.Ex.11 | — | — | — | — | — | — | — | — | — |

By comparing the crystal sizes of the coats obtained in Working Examples 1–6 and those of Comparative Examples 12–13, it is understood that the existence of monovalent alkaline metal ions, together with a large amount of water included in the aqueous agent of the invention, helps the formation of a zinc phosphate coat having fine crystals.

In Comparative Examples 6 and 7, the test panels were treated with the zinc phosphate coat-forming agents without degreasing in advance. Due to a poor degreasing, uniform zinc phosphate coats were not formed in these comparative examples, which would obviously have led to a failure in the production of final articles if the paint had been applied to the surfaces. On the other hand, in Working Examples 1–6, degreasing was carried out at the same time as forming the zinc phosphate coats. Consequently, uniform zinc phosphate coats were formed, which resulted in good paint-coating.

In Comparative Examples 9 and 11, precipitates were separated when the treating agents were prepared. It meant that the intended compositions could not be prepared, and the following evaluations were not carried out.

In Comparative Examples 8 and 10, uniform compositions were obtained when the treating agents were prepared. However, while they were being heated to a temperature of the application, precipitates were separated and the intended compositions were not achieved. Therefore the following evaluations were not done.

Oil Addition the Agents of Working Examples 1–6 and Comparative Examples 12 and 13

To each of the aqueous agents prepared in Working Examples 1–6 and the treating agents in Comparative Examples 12 and 13 was added oil in an amount shown in Table 12. The oil was cutting oil No. 1 produced by Yushiro Chemical Industries, Co., Ltd. A cold rolled steel plate (SPCC-SD) was treated with each of the agents to which the oil had been added. Uniformity of each of the agents for the amount of oil was evaluated with a naked eye. Also, the amount of oil adhering to the plate was measured by treating the oil-added agents using a treating plate. The results of the evaluation and measurement are shown in Table 12.

As understood from Table 12, the aqueous agents of Working Examples 1–12 were uniform when oil was added thereto, because the oil was made to float to the surface. Moreover, the separated oil could be removed from the aqueous agents with a separating funnel. On the other hand, as the amount of the oil was increased, the treating agents of Comparative Examples 12 and 13 became cloudy or separated into layers. As a result, the treating agents could not be used as a zinc phosphate coat-forming agent.

TABLE 12

| | Added oil | | | | | | | | | |
|---|---|---|---|---|---|---|---|---|---|---|
| | 0% | | 2% | | 4% | | 6% | | 8% | |
| | 1* | 2* | 1* | 2* | 1* | 2* | 1* | 2* | 1* | 2* |
| W.Ex.1 | Uniform | 3.4 | Uniform | 3.8 | Uniform | 3.2 | Uniform | 3.5 | Uniform | 3.3 |
| W.Ex.2 | | 1.8 | | 1.9 | | 2.0 | | 1.7 | | 2.0 |
| W.Ex.3 | | 1.5 | | 1.9 | | 2.3 | | 1.6 | | 1.8 |
| W.Ex.4 | | 4.5 | | 5.2 | | 5.9 | | 4.3 | | 4.0 |
| W.Ex.5 | | 7.0 | | 8.5 | | 6.8 | | 7.6 | | 8.1 |
| W.Ex.6 | | 3.9 | | 4.1 | | 3.6 | | 4.1 | | 4.0 |
| C.Ex.12 | | 2.5 | | 2.6 | Cloudy | 0.9 | Separated | 0.45 | Separated | 0.38 |
| C.Ex.13 | | 1.5 | Cloudy | 1.8 | Separated | 0.6 | | 0.35 | | 0.24 |

Notes

*1 Uniformity of the treating agent

*2 Weight of oil adhering to the plate ($g/m^2$)

Industrial Applicability

The aqueous agent for treating metal surfaces in accordance with the invention is one including the components for forming a zinc phosphate coat and an aqueous solution that comprises a water-soluble organic solvent and water of which amount is larger than the amount of the water-soluble organic solvent. By treating a metal article with this aqueous agent, removing oil from the surface of the metal article and forming a zinc phosphate coat on the surface can be carried out simultaneously. This invention provides an aqueous agent for treating metal surfaces that can form a zinc phosphate coat excellent in adhesion and preservative properties on the treated surface. This agent has a lasting degreasing function and it can be used repeatedly. It is because the agent makes oil removed from the metal surface float to the surface, which prevents the agent from separating into two layers and becoming cloudy. In summary, this invention provides an aqueous agent for treating metal surfaces that has the lasting functions of degreasing and forming a zinc phosphate coat.

Since this agent includes water in a larger amount than the water-soluble organic solvent, it does not require solubilizers that dissolve phosphoric acid and zinc ions uniformly. This prevents the agent from producing sludge due to decrease in its pH value. Therefore the agent can release the user from a frequent check of the apparatus resulting from the increase in the amount of sludge, and decrease the number of defective treated metal articles.

What is claimed is:

1. An aqueous agent for treating metal surfaces including 100 parts by weight of an aqueous solution that comprises from more than 12 weight % to less than 50 weight % of a water-soluble organic solvent and from more than 50 weight % to less than 88 weight % of water, 0.01–4.25 parts by weight of phosphate ions, 0.02–45 parts by weight of nitrate ions, and 0.01–6.5 parts by weight of zinc ions.

2. The aqueous agent as claimed in claim 1, wherein the aqueous solution comprises from more than 12 weight % to 45 weight % of the water-soluble organic solvent and from 55 weight % to less than 88 weight % of the water.

3. The aqueous agent as claimed in claim 1, the water-soluble organic solvent is at least one glycol compound selected from the group consisting of diethylene glycol, triethylene glycol, tetraethylene glycol, propylene glycol, ethylene glycol monoalkyl ether, diethylene glycol monoalkyl ether and propylene glycol monoalkyl ether, or a mixture of the glycol compound with a lower alcohol.

4. The aqueous agent as claimed in claim 1, further including up to 6 parts by weight of monovalent ions of an alkaline metal.

5. The aqueous agent as claimed in claim 2, further including up to 6 parts by weight of monovalent ions of an alkaline metal.

6. The aqueous agent as claimed in claim 3, further including up to 6 parts by weight of monovalent ions of an alkaline metal.

* * * * *

UNITED STATES PATENT AND TRADEMARK OFFICE

CERTIFICATE OF CORRECTION

PATENT NO. : 6,540,845 B1
DATED : April 1, 2003
INVENTOR(S) : Masaki Oyama et al.

It is certified that error appears in the above-identified patent and that said Letters Patent is hereby corrected as shown below:

Column 8,
Line 65, “3minutes” should read -- 3 minutes --.

Column 12,
Table 9, under Heading 5 Day, Row C.Ex.13 “0” should read -- 1 --.
Table 9, under Heading 60 Days, Row C.Ex.13 “3 mm” should read -- 5 mm --.

Column 15,
Line 1, delete “Industrial Applicability”.

Signed and Sealed this

Twenty-third Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,540,845 B1
DATED : April 1, 2003
INVENTOR(S) : Masaki Oyama et al.

It is certified that error appears in the above-identified patent and that said Letters Patent is hereby corrected as shown below:

Title page,
Item [22], PCT Filed, "May 3, 2001" should read -- May 30, 2001 --.

Signed and Sealed this

Eleventh Day of November, 2003

JAMES E. ROGAN
*Director of the United States Patent and Trademark Office*